United States Patent [19]

Kratt

[11] Patent Number: 4,572,125

[45] Date of Patent: Feb. 25, 1986

[54] METHOD OF AND DEVICE FOR REGULATING ROTARY SPEED OF AN INTERNAL COMBUSTION ENGINE

[75] Inventor: Alfred Kratt, Trossingen, Fed. Rep. of Germany

[73] Assignee: Robert Bosch GmbH, Stuttgart, Fed. Rep. of Germany

[21] Appl. No.: 678,003

[22] Filed: Nov. 30, 1984

[30] Foreign Application Priority Data

Dec. 17, 1983 [DE] Fed. Rep. of Germany ..... 3345711

[51] Int. Cl.[3] ..... F02D 37/00

[52] U.S. Cl. ..... 123/325; 123/339

[58] Field of Search ..... 123/325, 326, 339

[56] References Cited

U.S. PATENT DOCUMENTS 4,203,395 5/1980 Cromas et al. ..... 123/339

4,392,467 7/1983 Miyagi et al. ..... 123/325

*Primary Examiner*—Andrew M. Dolinar

*Attorney, Agent, or Firm*—Michael J. Striker

[57] ABSTRACT

A system for regulating rotary speed of an internal combustion engine includes an idling volumetric efficiency or charge regulating system and an overrun or push cutoff system to maintain a minimum rotary speed of the engine during important operational modes. The system is provided with means which eliminate undesired overrun cutoff of intentionally increased rotary speeds of the engine induced by the idling volumetric efficiency regulating system. The actual value of the control signal produced by the regulating system is compared with a limit or threshold value and after the threshold is exceeded the function of the overrun cutoff device is blocked. The regulating system includes a PID regulator which in combination with the circuit of this invention produces a dynamic behavior of the resetting rotary speed of the overrun cutoff function.

7 Claims, 1 Drawing Figure

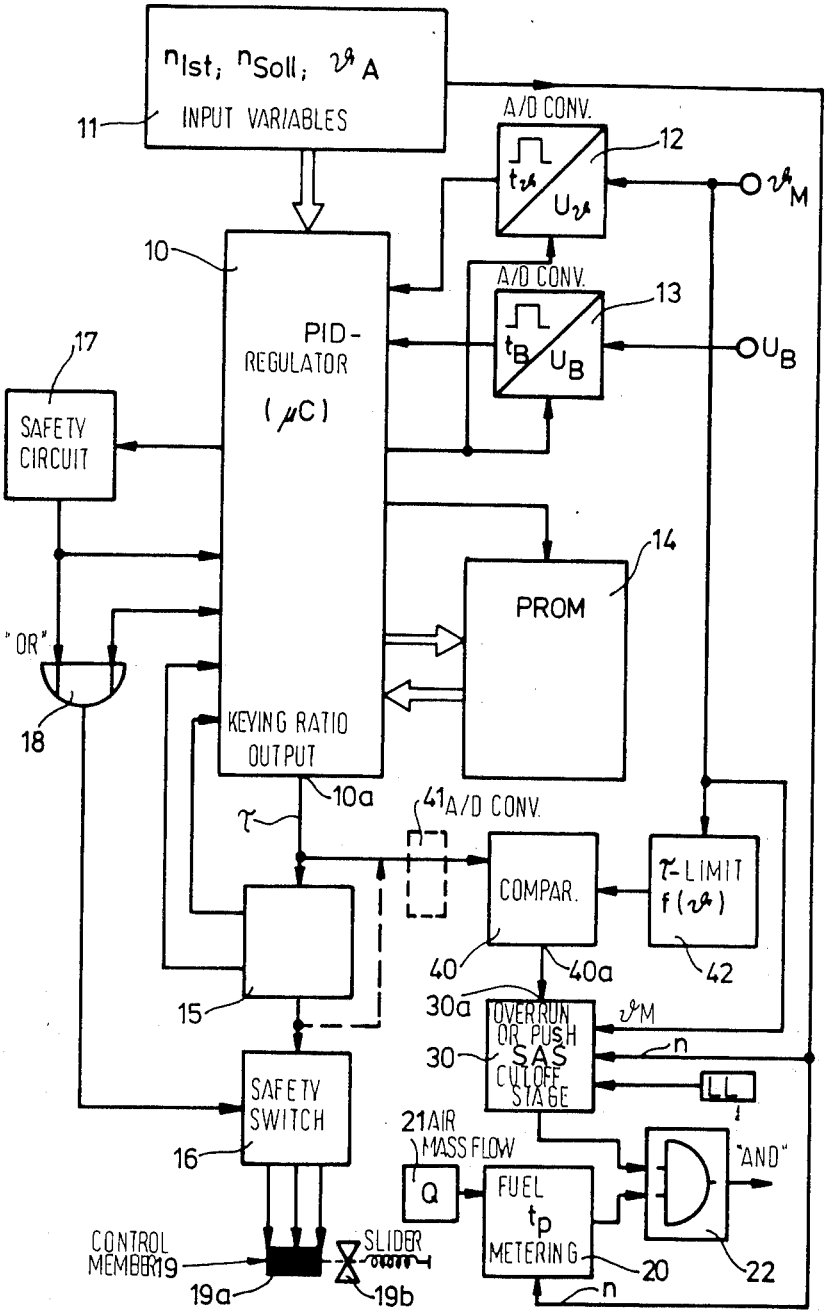
$n_{Ist}$; $n_{Soll}$; $\vartheta_A$
INPUT VARIABLES
11
A/D CONV.
12
$t_\vartheta$
$U_\vartheta$
$\vartheta_M$
10
A/D CONV.
13
$t_B$
$U_B$
$U_B$
PID-REGULATOR
(μC)
17
SAFETY CIRCUIT
14
PROM
"OR"
18
KEYING RATIO OUTPUT
10a
τ
41 A/D CONV.
COMPAR.
τ-LIMIT f(ϑ)
40
40a
42
15
30a
OVERRUN OR PUSH CUTOFF STAGE
SAS
30
$\vartheta_M$
n
SAFETY SWITCH
16
21 AIR MASS FLOW
Q
FUEL $t_p$ METERING
"AND"
CONTROL MEMBER 19
SLIDER
19a
19b
20
22
n

METHOD OF AND DEVICE FOR REGULATING ROTARY SPEED OF AN INTERNAL COMBUSTION ENGINE

BACKGROUND OF THE INVENTION

The present invention relates to a method of and a device for regulating rotary speeds of an internal combustion engine of a motor vehicle having an idling speed regulator or idling speed volume efficiency regulator for producing a control signal maintaining a minimum rotary speed, and a push or overrun cutoff device producing a cutoff signal for interrupting fuel supply when rotary speed of the engine exceeds the idling speed and simultaneously the motor vehicle is in an overrun or pushing operational condition.

Devices for regulating rotary speed of internal combustion engines are known from prior art. For example, it is conventional to provide an idling fuel mixture charge regulator which can operate in an air bypass arranged parallel to the throttle while usually a two winding rotary adjustor. Such prior art idling volumetric efficiency regulators (designed either by an analog or digital technology), by considering the momentary actual rotary speed of the engine, or the desired rotary speed and other peripheral data, are in position to maintain proper idling operation of the internal combustion engine, for example in the pulling or pushing (coasting) operation of the vehicle and during transition from the pushing operation into the idling one.

It has been known in internal combustion engines to interrupt during operation the fuel supply in the case when at higher or high rotary speeds the throttle plate is closed, that means when the engine is in the so-called overrun or pushing operational condition. Such a pushing operational condition occurs also in the case when the engine runs at a higher speed than that corresponding in the case of gasoline engine to the position of throttle plate or in the case of a diesel engine to the quantity of injected fuel. If the internal combustion engine is in an overrun or pushing operational condition then an increase of working power is undesired and consequently, the quantity of fuel supplied to the engine by the corresponding fuel mixture supply device (carburator, fuel injection system and the like) is either reduced or completely set to zero (overrun or push cutoff).

However, such prior art regulators do not guarantee a problem free operation when the two systems, which of necessity operate independently from one another, are brought into action. Such problems may result for example, when due to a corresponding activation of the idling volumetric efficiency regulator, the idling air filling adjuster is wide open due to operative conditions taken into consideration (for example during start or due to excessive warming up) and simultaneously the actual rotary speed of the engine momentarily exceeds the rotary speed which has been preset for the overrun or push cutoff. In the latter case both systems act: the overrun or push cutoff function is activated so that for example under certain extreme conditions a so-called sawtooth behavior (uncontrollable oscillating behavior) may occur. Under extreme conditions when the engine is cold, the engine may even become dead.

SUMMARY OF THE INVENTION

It is therefore a general object of the present invention to overcome the aforementioned disadvantages.

In particular, it is an object of this invention to avoid, in an internal combustion engine equipped with overrun or push cutoff system and with an idling charge or volumetric efficiency regulating system, an undesired cooperation of the two systems which might lead to disturbances in the engine operation.

In keeping with these objects and others which will become apparent hereafter, one feature of the invention resides, in an internal combustion engine having an idling speed regulator (idling volumetric efficiency regulator) for maintaining a mimum rotary speed and a push or overrun cutoff device for interrupting fuel supply when rotary speed exceeds the idling speed and simultaneously the engine is in an overrun or push operation, in the steps of comparing the control signal from the idling speed regulator with a preset limit value and if the limit value is exceeded, blocking the function of the overrun or push cutoff device.

The method of this invention has the advantage that the overrun or push cutoff is always inhibited in the case when the opening of the adjustor of the idling speed regulator may cause excessive increase of rotary speed which in turn causes the overrun or push cutoff.

Accordingly, it is prevented under all circumstances that due to the simultaneous functioning of the idling speed regulator (idling volumetric efficiency regulator) and of the overrun or push cutoff, a generation of sawtooth oscillations in the rotary speed of the engine may occur. The invention rectifies this undesired operational condition and reliably removes interferences under driving conditions where hitherto critical situation may occur for example directly after the starting or declutching, when the motor vehicle has been braked below the idling rotary speed.

In order to meet all requirements for a proper idling of an internal combustion engine and particularly in order to enable a reliable actuation of emergency functions when the engine is prone to stop, the idling volumetric efficiency or charge regulating system includes a regulator having PID regulating behavior. The latter regulator is constructed either by an analog technology or as it is preferred to at present time, on the basis of digitally operating systems. By virtue of the PI behavior of the idling speed regulating system the invention provides an additional advantage due to the fact that the resetting rotary speed of the overrun or push cutoff device is dynamic. When considering the latter quality from the side of the overrun or push cutoff device, it means that at falling rotary speed fuel is supplied again at a higher resetting rate than in the case of slowly falling rotary speed, that is the fuel injection system resumes the fuel injection at the higher rotary speed. The reason for this dynamic behavior is the fact that due to the speed allowance or lead of the D-component in the PID behavior of the idling volumetric efficiency regulator, the magnitude of the computed adjuster control signal T is the larger the faster falls the rotary speed of the engine. Since due to the concept of this invention, the computed adjuster control signal T is compared with a preset limit value or threshold T' and the overrun or push cutoff function is inhibited or blocked as soon as the computed signal T is larger than the threshold signal T', it results that at fast falling rotary speeds of the engine the computed signal T exceeds the threshold value T' much earlier (T-component) and therefore the overrun or push cutoff function is also blocked earlier. The basic concept of this invention relates to the function of the overrun or push cutoff system and establishes a dynamic overrun cutoff action without necessitating additional circuits or components.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE shows in a schematic block circuit diagram the basic layout of an idling volumetric efficiency regulating system in combination with an overrun or push cutoff system cooperating with the former in accordance with this invention.

DESCRIPTION OF THE PREFERRED EMBODIMENT

For the sake of clarity, the invention is illustrated by way of discrete circuit blocks representing idling volumetric efficiency regulating system and an overrun or push cutoff system. It is to be noted however that the preferred embodiment of this invention operates on digital basis where the corresponding control signals are processed and interact under control of a program of a microprocessor equipped with correponding peripheral devices such as input and output systems, setting members, sensor input circuits, microcomputer. Alternatively, this invention can be also realized in an analog manner.

The following description of the exemplary embodiment of this invention therefore is directed to the functional cooperation of the illustrated functional units rather than to the cooperation of discrete component parts.

The idling volumetric efficiency regulating system is represented by a block 10 including a microprocessor or microcomputer uC programmed so as to exhibit PID regulating behavior and to deliver at its output 10*a* an adjustor control signal T.

In this particular embodiment, the microcomputer based idling volumetric efficiency regulating system 10 is connected to the following peripheral devices: input block 11 which feeds to the microcomputer uC the input signals to be processed such as the actual value of the momentary rotary speed $n_{ist}$, a desired value of the rotary speed $n_{soll}$ and the value of ambient temperature $d_A$. Two additional inputs of the microcomputer are supplied via analog/digital converters 12 and 13 with digital data corresponding to momentary engine temperature $d_M$ and to battery voltage $U_D$. An external storing device 14 (PROM) reads from and writes in the microcomputer of the block 10 additional data for determining the adjuster control signal D. As mentioned above, the microcomputer 10 is designed so as to function as a PID regulator and determines from the incoming input variables a desired basic keying ratio for the adjuster control signal T inclusive of corresponding correction value and addressing the external data storage device 14. The generated adjuster control signal T from the output 10*a* is supplied via an AND stage 15 to an intermediate safety block 16 which together with safety circuits 17 and OR gate 18 provides fail safe safety circuit which in connection with this invention, need not be discussed in detail. The output of safety block 16 is connected to an adjusting member 19.

In the preferred embodiment, the adjusting member 19 is constructed as a conventional two winding rotary adjuster 19*a* controlling a slider 29*b* which is arranged as an air bypass parallel to the throttle plate and whose desired throughflow cross-section is determined from the keying ratio of the sequence of pulses in the adjuster control signal T applied to the two winding rotary adjuster.

In this example, the fuel metering system for the internal combustion engine is represented for all possible forms thereof as a preliminary stage 20 (control multivibrating stage) generating so-called $t_p$ preliminary pulses. This fuel metering or preliminary stage 20 is supplied from an input block 21 with data of air mass or air quantity flow and at another input thereof with data n indicative of the rotary speed of the engine. The preliminary stage (or control multivibrator) 20 is connected at its output to an input of an "AND" gate 22. The other input of gate 22 is connected to an overrun or push cutoff stage 30 (SAS) and the output of the AND gate 22 is connected to a control stage of a fuel injection system. Accordingly, the preliminary pulses $p_t$ are suppressed when the overrun or push cutoff stage recognizes operational condition "push" or "overrun" of the internal combustion engine. Corresponding input signals (engine temperature signal $d_M$, rotary speed signal n and idling signal LL) signal determining position of throttle plate are evaluated by the overrun or push cutoff device, as indicated by arrows.

According to this invention, there is detected first the magnitude or amplitude of the adjuster control signal T generated at the output of the PID regulator of the idling charge or volumetric efficiency regulating circuit. In the case of an analog generation of the signal T the latter can be applied immediately to an input of a comparator 40. When the adjuster control signal T is modulated by its keying ratio then a simple integrated circuit 41 is provided to convert this signal in an analog magnitude assuming that this invention operates on an analog basis. It is of advantage however, particular in this example of a digitally operating overrun system arrangement that also the function of this invention be realized by digital component part which can be immediately integrated in the overall combination of the idling volumetric efficiency regulating system and the overrun or push cutoff system, by adjusting corresponding program of the microcomputer and of the program store. Such a digital construction is particularly advantageous for those fuel injection control devices in which the idling volumetric efficiency regulating system is designed as an integrated unit.

The adjuster control signal T is compared in the comparator 40 with a suitable T-threshold value which is generated or preset in a threshold block 42. It has been found to be of advantage when the T-threshold signal is generated as a function of the engine temperature signal $d_M$, the function being selected such that the resulting threshold signal T' for each rotary speed of the engine be always smaller than the cutoff rotary speed of the overrun or push cutoff device.

Therefore, if comparator 40 finds the effective adjuster control signal T greater than the preset threshold signal T' than the output of the comparator provides information that the corresponding increase of the rotary speed of the engine is to be reset so as to provide an effective reaction of the idling volumetric efficiency regulating system 10. Accordingly the comparator 40 generates at its output 40*a* a blocking signal which is applied to the input 30*a* of the overrun or push cutoff stage 30 (SAS) to block the operation or function of the latter provided that as mentioned before, the adjuster control signal T is greater than the preset T'-threshold value. As a result the overall cutoff function of the overrun or push operation of the engine in the block 30 is inhibited.

The invention therefore enables to establish a clear separation line between the function of the idling volumetric control regulating system and the overrun or push cutoff system, thereby eliminating the mutual undesired effects of the two systems on each other so that a flawless controlling process of the momentary rotary speeds of the engine is guaranted without causing unpredictable oscillations during a uniform transition.

It will be understood that each of the elements described above, or two or more together, may also find a useful application in other types of constructions differing from the types described above.

While the invention has been illustrated and described as embodied in connection with a specific example of digital regulating and cutoff systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of regulating a rotary speed of an internal combustion engine provided with an idling speed regulating system producing a control signal for maintaining a minimum rotary speed and with an overrun or push cutoff device producing a cutoff signal for interrupting the fuel supply when rotary speed exceeds an idling speed and the engine is simultaneously in an overrunning or pushing operational condition, comprising the steps of comparing the control signal with a preset limit value and, when the limit value is exceeded, blocking the function of the overrun or push cutoff device.

2. A method as defined in claim 1, wherein the preset limit value is determined as a function of engine temperature and selected such that rotary speed of the engine pertaining to each limit value is always smaller than the cutoff rotary speed of the overrun or push cutoff device.

3. A method as defined in claim 2, wherein the idling speed regulating system has a PID regulating behavior and by means of D component of the idling speed regulating system the resetting rotary speed of the overrun or push cutoff device is dynamically established such that at a rapidly falling rotary speed of the engine the fuel supply is restored at a higher resetting rotary speed than at slow falling rotary speed, whereby the control signal generated by the PID regulator of the idling speed regulating system reaches the preset limit value at an earlier time point.

4. A device for regulating a rotary speed of an internal combustion engine having an idling speed regulating system producing a control signal for maintaining a minimum rotary speed, and an overrun or push cutoff device producing a cutoff signal for interrupting fuel supply when rotary speed exceeds an idling speed and simultaneously the engine is in an overrunning or pushing operational condition, comprising means for generating a preset limit value for the control signal, a comparator arranged for comparing a momentary actual value of the generator control signal with the preset limit value and generating an output blocking signal applied to the overrun or push cutoff device to stop the operation of the latter when the control signal exceeds the limit value.

5. A device as defined in claim 4, wherein the comparator is an analog comparator, the control signal being modulated with its keying ratio and being applied to the comparator via a digital to analog converter.

6. A device as defined in claim 4, wherein the idling speed regulating system is an idling volumetric efficiency regulating system including a PID regulator, the D component of which is dimensioned such that at rapid drop of rotary speed of the engine the resetting rotary speed of the overrun or push cutoff device is dynamically increased by the overrun or push cutoff device to a higher resetting rotary speed.

7. A device as defined in claim 4, wherein said means for generating a preset limit value generates the latter as a function of the engine temperature.

* * * * *